US009751728B2

(12) United States Patent
Mertala

(10) Patent No.: US 9,751,728 B2
(45) Date of Patent: Sep. 5, 2017

(54) METHOD AND AN ARRANGEMENT FOR INSTALLING ELEVATOR GUIDE RAILS

(71) Applicant: KONE CORPORATION, Helsinki (FI)

(72) Inventor: Antti Mertala, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/090,208

(22) Filed: Apr. 4, 2016

(65) Prior Publication Data

US 2016/0311659 A1 Oct. 27, 2016

(30) Foreign Application Priority Data

Apr. 23, 2015 (EP) ..... 15164768

(51) Int. Cl.
*B66B 19/00* (2006.01)
*E04G 3/24* (2006.01)
*E04G 3/28* (2006.01)

(52) U.S. Cl.
CPC ..... *B66B 19/002* (2013.01); *E04G 3/246* (2013.01); *E04G 3/28* (2013.01); *E04G 2003/286* (2013.01)

(58) Field of Classification Search
CPC ..... B66B 19/002; B66B 19/00; B66B 19/02; B66B 11/00; Y10T 29/49828
See application file for complete search history.

(56) References Cited

U.S. PATENT DOCUMENTS 3,851,736 A * 12/1974 Westlake ..... B66B 19/002 29/429
4,345,671 A * 8/1982 Tosato ..... B66B 19/002 29/429
5,018,923 A * 5/1991 Melan ..... F27D 1/1621 182/128
5,065,843 A * 11/1991 Richards ..... B66B 19/002 187/408
7,444,732 B2 * 11/2008 Cruz ..... B66B 19/002 187/408

(Continued)

FOREIGN PATENT DOCUMENTS

EP 2 746 210 A1 6/2014
WO WO 2013/186096 A1 12/2013

*Primary Examiner* — Rodney Mintz
*Assistant Examiner* — Daniel Kenny
(74) *Attorney, Agent, or Firm* — Birch, Stewart, Kolasch & Birch, LLP

(57) ABSTRACT

A method includes plumbing an elevator shaft, installing a lowermost first section of guide rail elements manually to walls of the shaft, arranging an upwards and downwards in the shaft with a first hoist movable lifting frame, arranging an upwards and downwards in the shaft with a second hoist movable installation platform provided with a guide apparatus, an installation apparatus and an alignment tool, drilling holes and fastening support brackets to the walls of the shaft with the installation apparatus, lifting guide rail elements with a third hoist from the lifting frame and guiding said guide rail elements into position with the guide apparatus, joining consecutive guide rail elements with the installation apparatus, and aligning opposite guide rail elements with the alignment tool and locking the support brackets with the installation apparatus.

25 Claims, 14 Drawing Sheets

(56) References Cited

U.S. PATENT DOCUMENTS

| | | | | |
|---|---|---|---|---|
| 8,720,032 | B2 * | 5/2014 | Van der Meijden | B66B 19/02 187/414 |
| 9,169,107 | B2 * | 10/2015 | Wilts | B66B 19/002 |
| 9,592,997 | B2 * | 3/2017 | Mertala | B66B 19/002 |
| 2009/0223751 | A1 * | 9/2009 | Peacock | B66B 19/00 187/414 |
| 2010/0133048 | A1 * | 6/2010 | Barneman | B66B 19/00 187/414 |
| 2013/0118838 | A1 * | 5/2013 | Plathin | D07B 1/02 187/251 |
| 2015/0107186 | A1 | 4/2015 | Wilts et al. | |
| 2015/0314993 | A1 | 11/2015 | Bolme et al. | |
| 2016/0060078 | A1 * | 3/2016 | Mertala | B66B 19/002 52/741.1 |

* cited by examiner

METHOD AND AN ARRANGEMENT FOR INSTALLING ELEVATOR GUIDE RAILS

FIELD OF THE INVENTION

The invention relates to a method and an arrangement for installing elevator guide rails.

BACKGROUND ART

An elevator comprises an elevator car, lifting machinery, ropes, and a counter weight. The elevator car is supported on a transport frame being formed by a sling or a car frame. The sling surrounds the elevator car. The lifting machinery moves the car upwards and downwards in a vertically extending elevator shaft. The sling and thereby also the elevator car are carried by the ropes, which connect the elevator car to the counter weight. The sling is further supported with gliding means at guide rails extending in the vertical direction in the elevator shaft. The gliding means can comprise rolls rolling on the guide rails or gliding shoes gliding on the guide rails when the elevator car is moving upwards and downwards in the elevator shaft. The guide rails are supported with support means on the side wall structures of the elevator shaft. The gliding means engaging with the guide rails keep the elevator car in position in the horizontal plane when the elevator car moves upwards and downwards in the elevator shaft. The counter weight is supported in a corresponding way on guide rails supported with support means on the wall structure of the elevator shaft. The elevator car transports people and/or goods between the landings in the building. The elevator shaft can be formed so that the one or several of the side walls are formed of solid walls and/or so that one or several of the side walls are formed of an open steel structure.

The guide rails are formed of guide rail elements of a certain length. The guide rail elements are connected in the installation phase end-on-end one after the other in the elevator shaft. The guide rail elements are attached to each other with connection plates extending between the end portions of two consecutive guide rail elements. The guide rails are attached to the walls of the elevator shaft with support means at support points along the height of the guide rails.

BRIEF DESCRIPTION OF THE INVENTION

An object of the present invention is to present a novel method and arrangement for installing guide rails into an elevator shaft.

The method for installing guide rails into an elevator shaft is defined in claim 1.

The method for installing guide rails into an elevator shaft comprises the steps of:

plumbing the shaft and arranging plumb lines in the shaft in the vicinity of car guide rail lines in accordance with the result of the plumbing, installing manually a lowermost first section of guide rail elements to respective walls of the shaft starting from a bottom floor level of the shaft, characterised by the further steps of:

lifting guide rail elements from a storage area with a lifting frame being glidingly supported on counter weight guide rails and being movable upwards and downwards in the shaft with a first hoist, arranging an installation platform being glidingly supported on car guide rails and being movable upwards and downwards in the shaft with a second hoist, said installation platform being provided with a guide apparatus, an installation apparatus and an alignment tool, drilling holes and fastening support brackets to the walls of the elevator shaft with the installation apparatus, lifting guide rail elements with a third hoist from the lifting frame and guiding said guide rail elements into position with the guide apparatus, joining consecutive guide rail elements and attaching guide rail elements to the support brackets with the installation apparatus, aligning opposite guide rail elements with the alignment tool based on the plumb lines at each support bracket along the height of the guide rail element, locking the support brackets and thereby the guide rail elements with the installation apparatus.

The arrangement for installing guide rails into an elevator shaft is defined in claim 7.

The arrangement for installing guide rails into an elevator shaft comprises:

a lifting frame being glidingly supported on the counter weight guide rails, being arranged to move upwards and downwards in the shaft with a first hoist and being used to lift guide rail elements from a storage area, an installation platform being glidingly supported on the car guide rails, being arranged to move upwards and downwards in the shaft with a second hoist and being provided with a guide apparatus, an installation apparatus and an alignment tool, whereby:

holes are drilled and support brackets are fastened to the walls of the elevator shaft with the installation apparatus, guide rail elements are lifted with a third hoist from the lifting frame and said guide rail elements are guided into position with the guide apparatus, consecutive guide rail elements are joined and guide rail elements are attached to the support brackets with the installation apparatus, opposite guide rail elements are aligned with the alignment tool based on the plumb lines at each support bracket along the height of the guide rail element, the support brackets are locked and thereby also the guide rail elements with the installation apparatus.

The method and the arrangement make it possible to automate the installation process of guide rails in an elevator shaft. A first lowermost section of guide rails is first installed manually after which the following sections can be installed automatically with the method and the arrangement according to the invention. Also the alignment of the guide rails can be done automatically with the method and the arrangement according to the invention.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
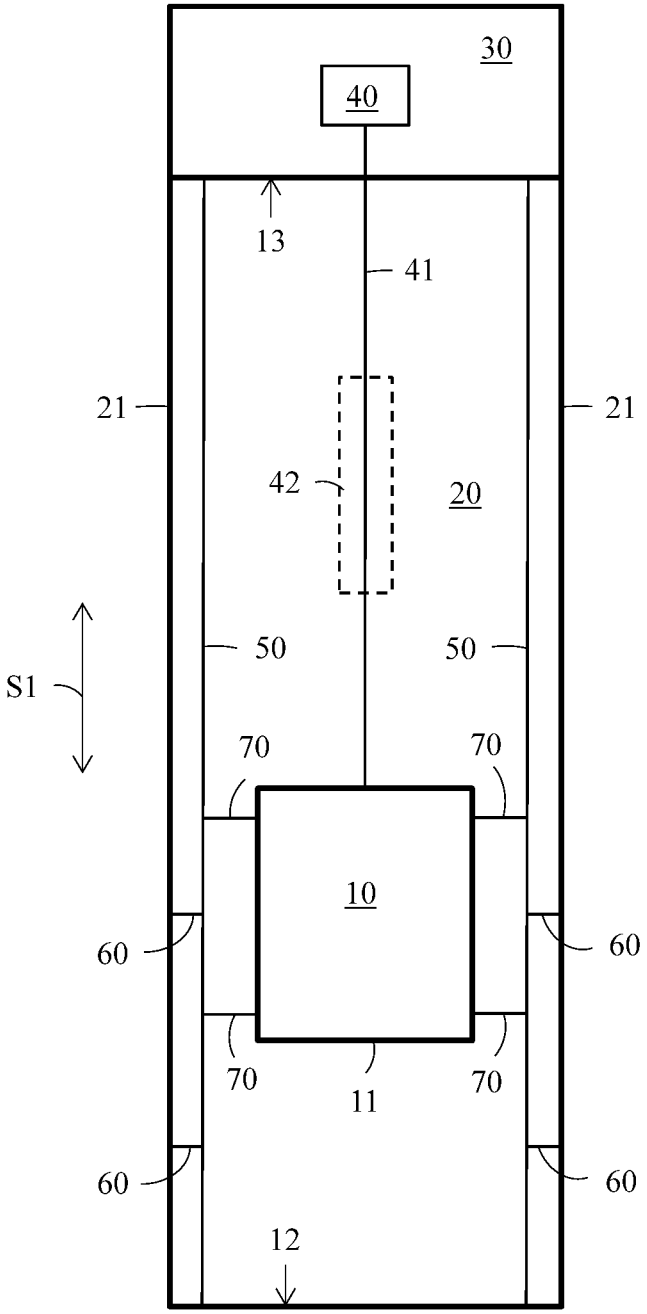
FIG. 1 shows a vertical cross section of an elevator.
Figure 2:
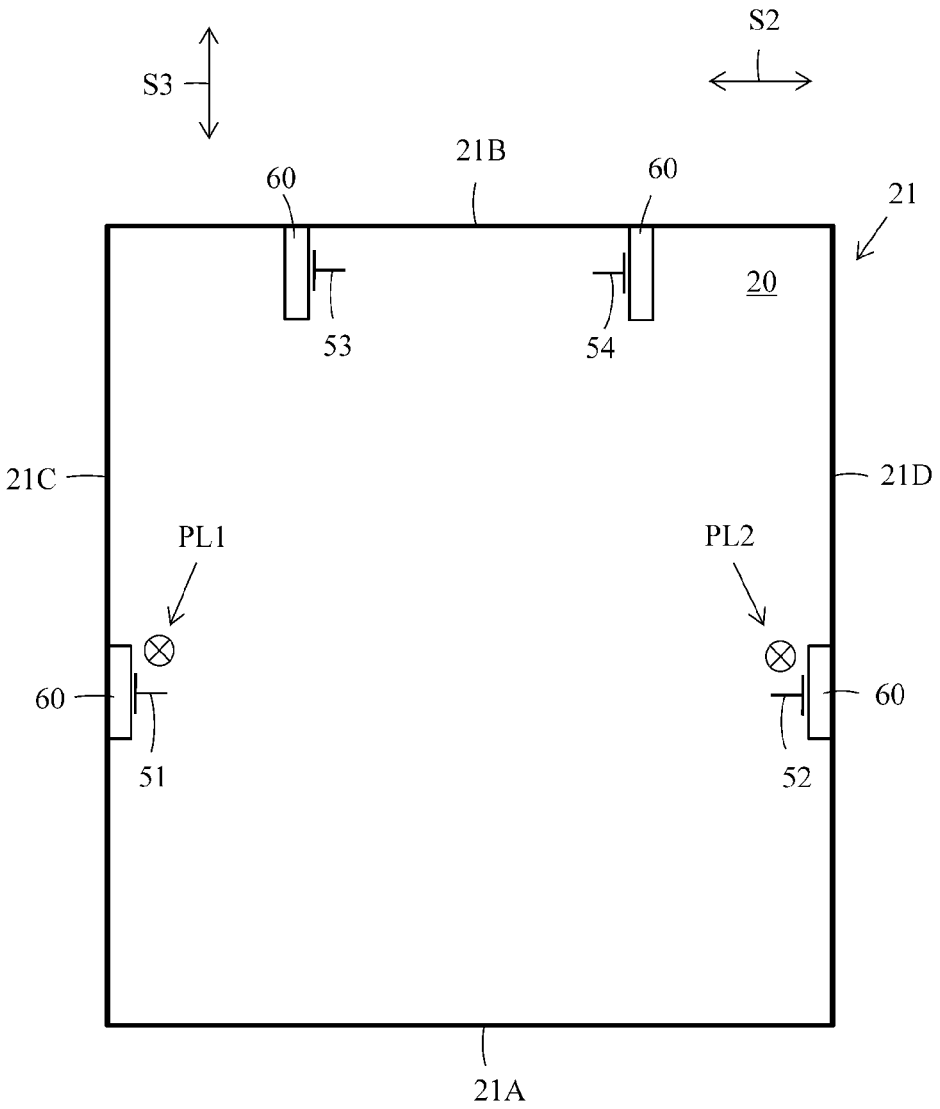
FIG. 2 shows a horizontal cross section of the elevator.

FIG. 1 shows a vertical cross section and FIG. 2 shows a horizontal cross section of an elevator.

The elevator comprises a car 10, an elevator shaft 20, a machine room 30, lifting machinery 40, ropes 41, and a counter weight 42. The car 10 may be supported on a transport frame 11 or a sling surrounding the car 10. The lifting machinery 40 moves the car 10 in a first direction S1 upwards and downwards in a vertically extending elevator shaft 20. The sling 11 and thereby also the elevator car 10 are carried by the ropes 41, which connect the elevator car 10 to the counter weight 42. The sling 11 and thereby also the elevator car 10 is further supported with gliding means 70 at guide rails 50 extending in the vertical direction in the elevator shaft 20. The shaft 20 has a bottom 12, a top 13, a front wall 21A, a back wall 21B and two opposite side walls 21C, 21D. There are two guide rails 51, 52 for the elevator car 10. The elevator car guide rails 51, 52 are positioned on opposite side walls 21C, 21D of the shaft 20. The gliding means 70 can comprise rolls rolling on the guide rails 50 or gliding shoes gliding on the guide rails 50 when the elevator car 10 is mowing upwards and downwards in the elevator shaft 20. There are further two guide rails 53, 54 for the counter weight 42. The counter weight guide rails 53, 54 are positioned at the back wall 21B of the shaft 20. The counter weight 42 is supported with corresponding gliding means 70 on the counter weight guide rails 53, 54. The landing doors (not shown in the figure) are positioned in connection with the front wall 21A of the shaft 20.

The guide rails 50 are fastened with support means 60 at the side walls 21C, 21D and the back wall 21B of the shaft 20 along the height of the guide rails 50. The figure shows only two support means 60, but there are several support means 60 along the height of each guide rail 50. The cross section of the guide rails 50 can have the form of a letter T. The vertical branch of the guide rail element 50 forms three gliding surfaces for the gliding means 70 comprising rolls or gliding shoes. There are thus two opposite side gliding surfaces and one front gliding surface in the guide rail 50. The cross-section of the gliding means 70 could have the form of a letter U so that the inner surface of the gliding means 70 sets against the three gliding surfaces of the guide rail 50. The gliding means 70 are attached to the sling 11 and/or to the counter weight 42. The support means 60 can be formed of brackets having two parts. A first part of the bracket can be attached to the side wall 21C, 21D or the back wall 21B of the shaft 20 and a second part of the bracket can be attached to the guide rail 51, 52, 53, 54, whereby said bracket parts are movable in relation to each other and attached with bracket bolts to each other. Loosening of the bracket bolts between the two bracket parts makes it possible to move the two bracket parts in relation to each other and thereby also the guide rail 50 in relation to the shaft, whereby the guide rail 50 can be aligned.

The gliding means 70 engage with the guide rails 50 and keep the elevator car 10 and/or the counter weight 42 in position in the horizontal plane when the elevator car 10 and/or the counter weight 42 moves upwards and downwards in the elevator shaft 20. The elevator car 10 transports people and/or goods between the landings in the building. The elevator shaft 20 can be formed so that the walls 21, 21A, 21B, 21C, 21D are formed of solid walls or so that the walls 21, 21A, 21B, 21C, 21D are formed of an open steel structure.

The guide rails 50 extend vertically along the height of the elevator shaft 20. The guide rails 50 are thus formed of guide rail elements of a certain length e.g. 5 m. The guide rail elements 50 are installed end-on-end one after the other.

FIG. 1 shows a first direction S1, which is a vertical direction in the elevator shaft 20. FIG. 2 shows a second direction S2, which is the direction between the guide rails (DBG) and a third direction S3, which is the direction from the back wall to the front wall (BTF) in the shaft 20. The second direction S2 is perpendicular to the third direction S3. FIG. 2 shows also plumb lines PL1, PL2, which are a result of the plumbing of the shaft 20 at the beginning of the installation of the elevator. The plumb lines PL1, P12 are in the vicinity of the car guide rails 51, 52, whereby they can be used to align the car guide rails 51, 52 and the counter weight guide rails 53, 54 during the installation of the guide rails 51, 52 and the counter weight guide rails 53, 54.

FIGS. 3-6 show different phases in the installation process of the guide rails.

The shaft 20 is plumbed and plumbing lines PL1, PL2 are arranged in the vicinity of the car guide rails 51, 52 (shown in FIG. 2). The plumb lines PL1, PL2 can be formed with traditional vires or with light sources e.g. lasers having the beams directed upwards along the plumb lines PL1, PL2. The plumb lines PL1, PL2 can then be used to adjust the guide rails 50. The first section of guide rail elements 50 i.e. the lowermost guide rails 50 are installed manually starting from the bottom floor 12 of the elevator shaft 20.

Figure 3:
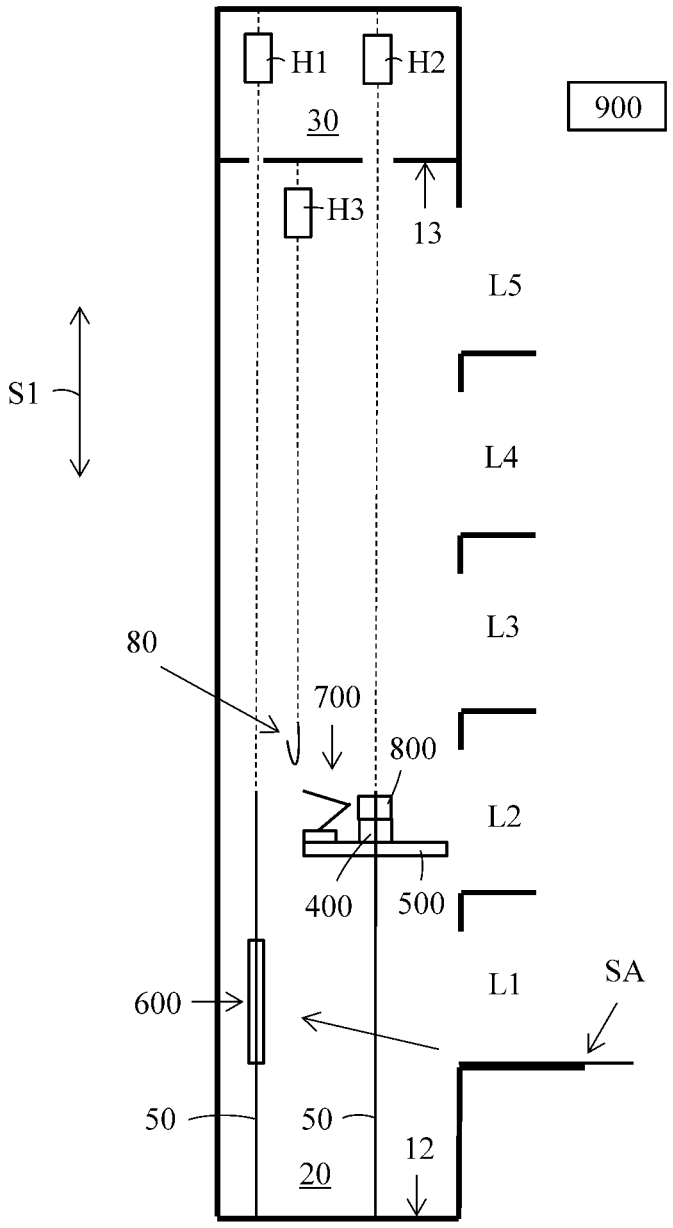
FIGS. 3-6 show different phases in the installation process of the guide rails.

FIG. 3 shows the situation where a lifting frame 600 and an installation platform 500 have been installed into the shaft 20 in connection with the first section of guide rails 50. A storage area SA has also been arranged in connection with the first landing L1. The figure shows five landings L1-L5, but there could naturally be any number of landings in the shaft 20.

The lifting frame 600 can be moved upwards and downwards in the shaft 20 with a first hoist H1 being suspended from the top 13 of the shaft 20. The lifting frame 600 is supported on the opposite counter weight guide rails 53, 54 with suitable gliding means e.g. glide shoes or rolls gliding on the counter weight guide rails 53, 54. The lifting frame 600 is thus kept laterally in position by the gliding means gliding on the counter weight guide rails 53, 54 during the upwards and downwards movement in the shaft 20. The lifting frame 600 can be loaded with guide rail elements 50. The guide rail elements 50 can be attached to the lifting frame 600 with snap locking means. A second part of the brackets may be attached to the guide rails elements 50 so that the second part of the bracket becomes into contact with the first part of the corresponding bracket when the guide rail 50 is lifted into position in the elevator shaft 20.

The installation platform 500 can be moved upwards and downwards in the shaft 20 with a second hoist H2 being suspended from the top 13 of the shaft 20. The installation platform 500 is supported on the opposite car guide rails 51, 52 with suitable gliding means e.g. glide shoes or rolls gliding on the car guide rails 51, 52. The installation platform 500 is thus kept in position in the lateral direction by the gliding means gliding on the car guide rails 51, 52 during the upwards and downwards movement in the shaft 20.

The installation platform 500 can be provided with a guide apparatus 700, an installation apparatus 800 and an alignment tool 400. The guide apparatus 700, the installation apparatus 800 and the alignment tool 400 can be installed stationary or movably on the installation platform 500. The guide apparatus 700, the installation apparatus 800 and the alignment tool 400 can be attached on a support frame that moves e.g. on rails on the installation platform 500. One or several electric motors could be used to move the support frame on the rails on the installation platform 500. There could further be brake means in order to be able to lock the support frame in any desired position on the installation platform 500. The installation platform 500 is then lifted upwards in the shaft 20 to a position near the upper end of the manually installed first section i.e. the lowermost car guide rails 51, 52 with the second hoist H2.

A storage area SA has been arranged on the first landing L1. The storage area SA could naturally be arranged at any position below the working level of the installation platform 500. The storage area SA could first be positioned on the first landing L1 and then later relocated to a higher landing as the installation advances. The guide rail elements 50 are stored on the storage area SA and loaded on the lifting frame 600 when the lifting frame 600 is empty. The loading of guide rail elements 50 on the lifting frame 600 can be done manually when the lifting frame 600 is in a lower position near the storage area SA.

The guide apparatus 700 could be an industry robot with a pivot arm and gripping means in order to be able to grip guide rails 50 and to lift guide rails into their position on the walls of the elevator shaft 20. The arm of the guide apparatus 700 can telescopic so that the guide apparatus 700 can reach upwards along the height of the guide rail elements 50. The industry robot should be able to work in any direction.

The installation apparatus 800 can be based on an industry robot with an arm. The installation apparatus 800 may be provided with different working units that can be installed on the arm for performing all the tasks in the fixing steps. The installation apparatus 800 will bore holes into respective side walls 21B, 21C, 21D of the shaft 20, install anchor bolts into the holes and attach the first wall part of the support brackets 60 to the anchor bolts. The arm of the installation apparatus 800 may be telescopic so that the installation apparatus 800 can reach upwards along the height of the guide rail elements 50. The industry robot should be able to work in any direction.

Figure 4:
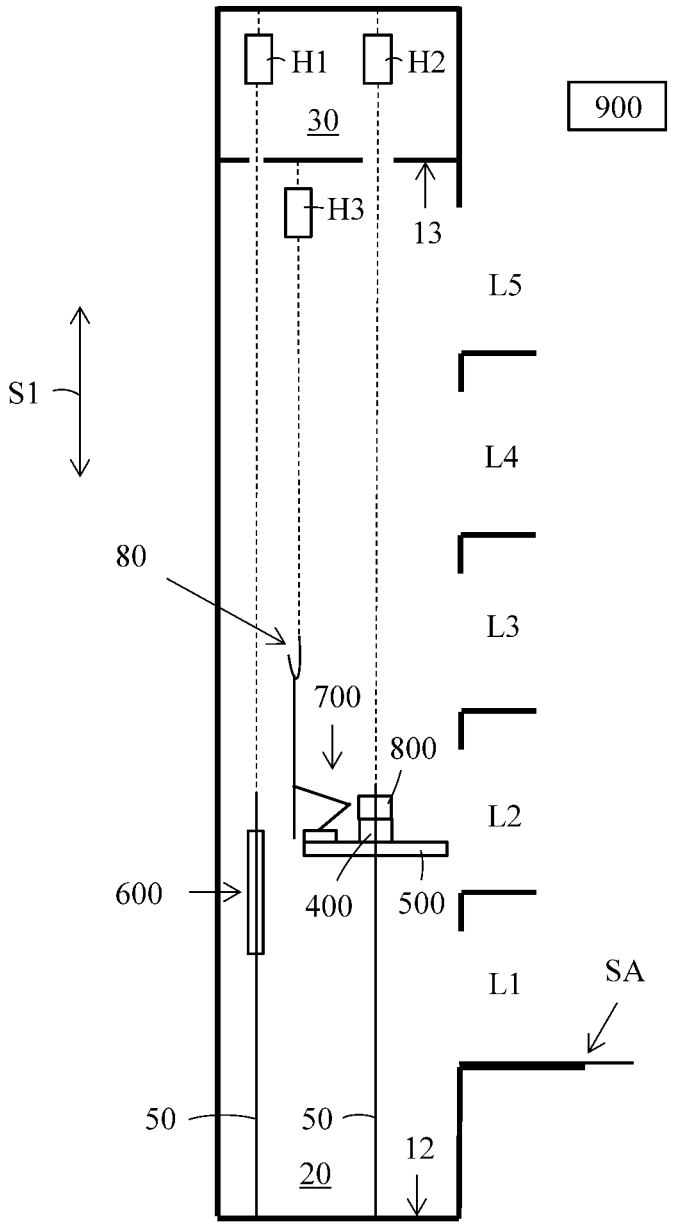

FIG. 4 shows a second phase in the installation of the guide rails. The lifting frame 600 is lifted upwards in the shaft 20 to a suitable position from which the guide apparatus 700 can fetch guide rail elements 50 from the lifting frame 600. The guide apparatus 700 is activated to guide gripping means 80 positioned on the lower end of a third hoist H3 to grip an upper end of a guide rail element 50 in the lifting frame 600. The third hoist H3 is also suspended from the top 13 of the shaft 20.

Figure 5:
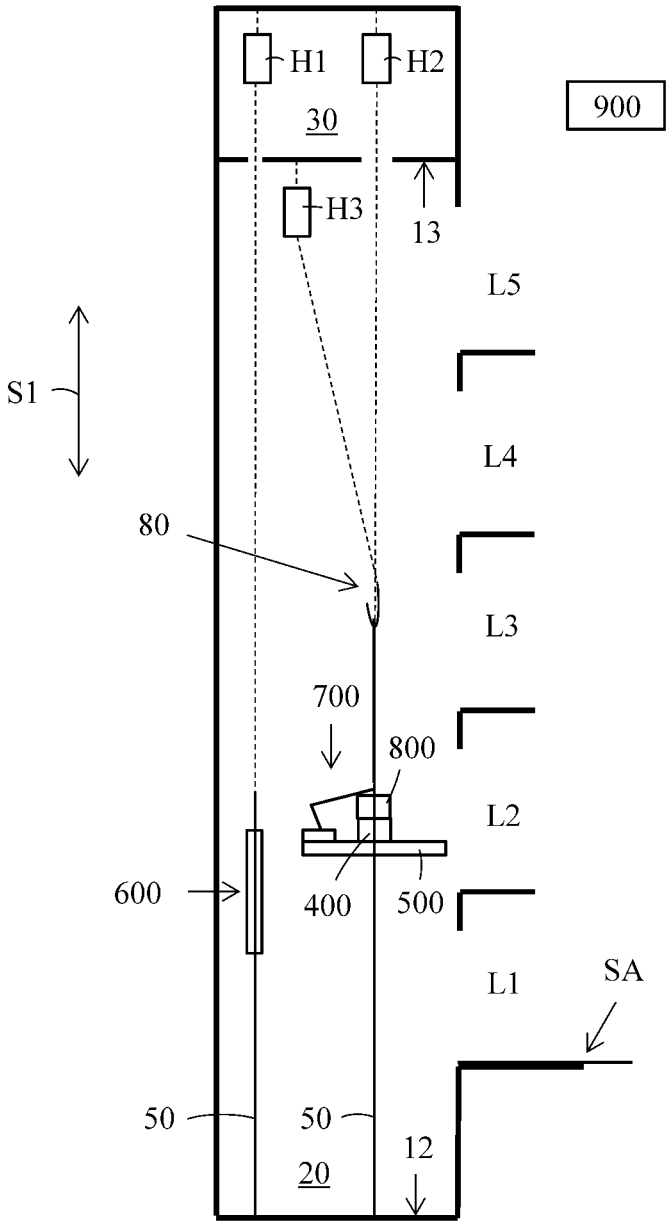

FIG. 5 shows a third phase in the installation of the guide rails. The installation is here started from the car guide rails 51, 52. The installation could naturally instead be started from the counter weight guide rails 53, 54.

A first car guide rail element 51 is lifted with the third hoist H3 and guided into place with the guide apparatus 700 end-on-end with a corresponding lower car guide rail element 51 in the first section on the first side wall 21C of the shaft 20. The lower end of the first car guide rail element 51 is joined to the upper end of the lower guide rail element with the installation apparatus 800. The fish plate joining the two consecutive guide rail elements may have been attached beforehand on the upper end of the lower guide rail element. The support brackets 60 are positioned at suitable distances from each other along the height of the car guide rail element 51. Each support bracket 60 may comprise two parts that are attached to each other with bracket bolts. A first wall part of the support bracket 60 is attached to the wall of the elevator shaft 20 and a second guide rail part is attached to the guide rail 51. The opening of the bracket bolts between the two parts of the support bracket 60 makes it possible to move the two parts of the support bracket 60 in relation to each other. The two parts of the support brackets 60 are attached to each other by installing the brackets bolts into each bracket when the two consecutive guide rail elements have been joined together. The first car guide rail element 51 becomes thus attached through the support brackets 60 to the wall of the elevator shaft 20. The bracket bolts are not finally tightened at this stage so that the car guide rail element 51 can later be adjusted with the alignment tool 400.

The gripping means 80 of the third hoist H3 is released from the first car guide rail 51. The gripping means 80 of the third hoist H3 is then lowered and guided with the guide apparatus 700 to grip an upper end of a second car guide rail element 52 in the lifting frame 600. The second opposite car guide rail element 52 in the second section is then lifted with the third hoist H3 from the lifting frame 600 and guided with the guide apparatus 700 into place end-on-end with the corresponding lower car guide rail element 52 in the first section on the opposite side wall 21D of the shaft 20. The above described fixing process of the support brackets 60 for the first car guide rail 51 will now be repeated for the second car guide rail 52. The gripping means 80 of the third hoist H3 is then released from the second car guide rail 52.

The two opposite car guide rail elements 51, 52 can then be aligned with the alignment tool 400 as will be described later in connection with FIGS. 12-15. The alignment tool 400 can be supported on the installation platform 500 and can be lifted with the installation platform 500 so that the alignment can be done at each fastening point along the height of the car guide rail elements 51, 52. The installation apparatus 800 tightens the bracket bolts in the support brackets 60 so that the two parts of the support brackets 60 become locked when the alignment tool 400 indicates that the car guide rail elements 51, 52 are aligned at said fastening point.

The counter weight guide rail elements 53, 54 in the second section can be installed in a corresponding way with the guide apparatus 700, the installation apparatus 800 and the alignment tool 400 on the installation platform 500. The counter weight rails 53, 54 need not be installed on the back wall 21B of the shaft 20. They could instead be installed on one of the side walls 21C, 21D of the shaft 20.

Figure 6:
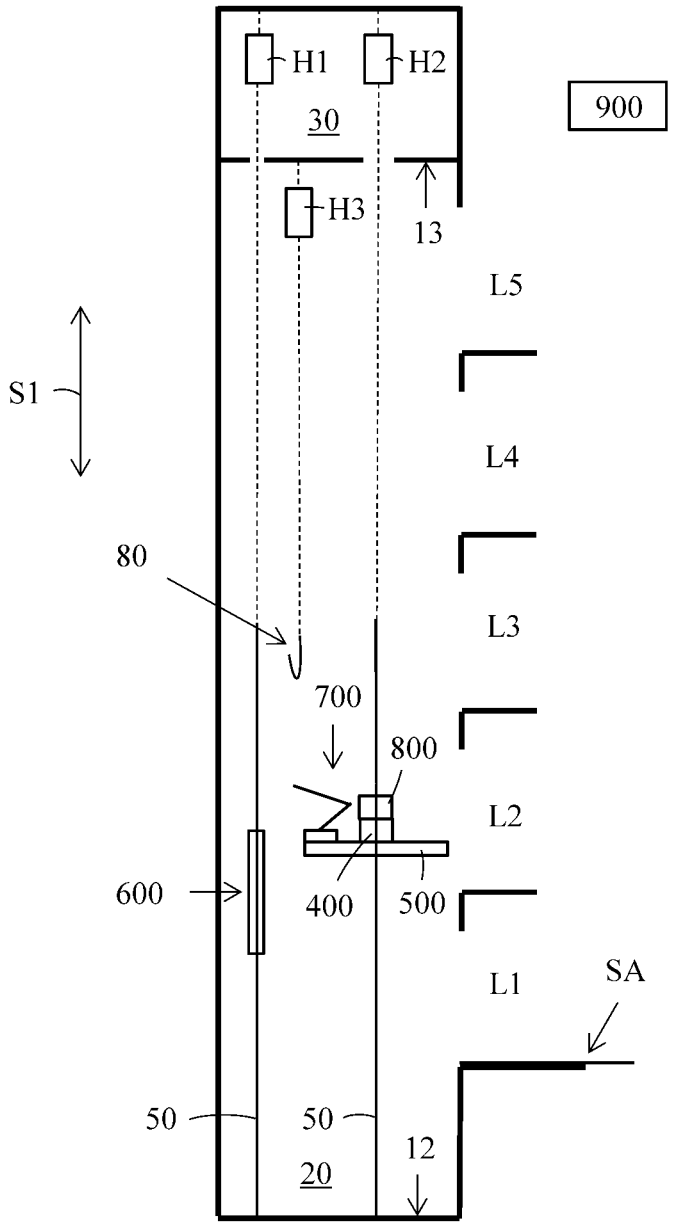

FIG. 6 shows a fourth phase in the installation of the guide rails. All the guide rails 51, 52, 53, 54 in the second section have been installed after which the installation process starts from the beginning in order to install the guide rails in the third section.

FIGS. 3-6 also show a main control unit 900 through which the operation of the hoists H1, H2, H3, the guiding apparatus 700, the installation apparatus 800 and the alignment tool 400 can be controlled. The main control unit 900 receives measurement results from the measurement equipment.

Figure 7:
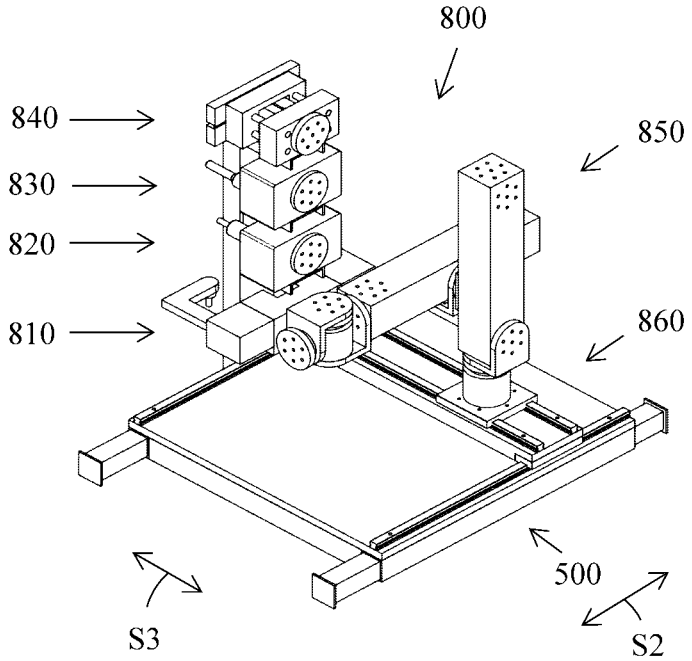
FIG. 7 shows an installation apparatus that can be used in the installation process.

FIG. 7 shows an installation apparatus that can be used in the installation process. The installation apparatus 800 comprises an industry robot 850 provided with four replaceable working units 810, 820, 830, 840. The four replaceable working units 810, 820, 830, 840 can be supported on a support rack attached to the installation apparatus 800. The four replaceable working units can be formed of a drilling unit 810, a bracket installing unit 820, a rail joining unit 830 and a bracket bolting unit 840. The industry robot 850 can be attached to a support frame 860 so that the industry robot can be moved in the second direction S2 and in the third direction S3 on the installation platform 500.

Figure 8:
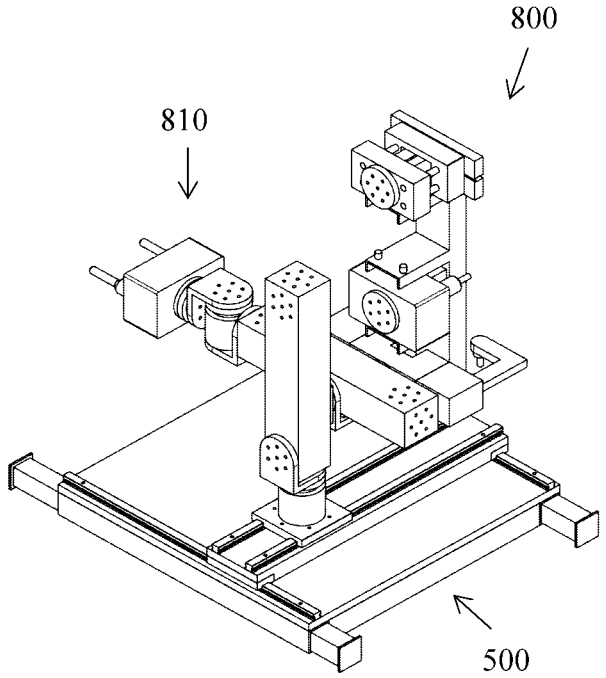
FIG. 8 shows the installation apparatus of FIG. 7 with a drilling unit.

FIG. 8 shows the installation apparatus of FIG. 7 with a drilling unit. The drilling unit 810 is attached to the outer end of the support arm of the industry robot 850. The drilling unit 810 is used to bore the holes into the wall 21 of the elevator shaft 20 for the anchor bolts.

Figure 9:
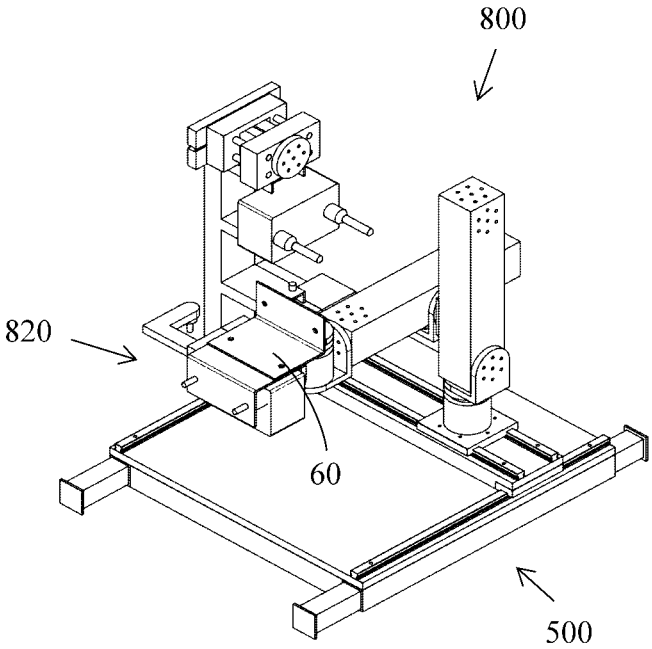
FIG. 9 shows the installation apparatus of FIG. 7 with a bracket installation unit.

FIG. 9 shows the installation apparatus of FIG. 7 with a bracket installation unit. The bracket installation unit 820 is attached to the outer end of the support arm of the industry robot 850. The bracket installation unit 820 comprises a magnet with which a bracket 60 can be attached to the bracket installation unit 820. The bracket installation unit 820 is used to attach the bracket 60 onto the wall 21 of the elevator shaft 20 with anchor bolts positioned in the holes that have been previously bored by the drilling unit 810.

Figure 10:
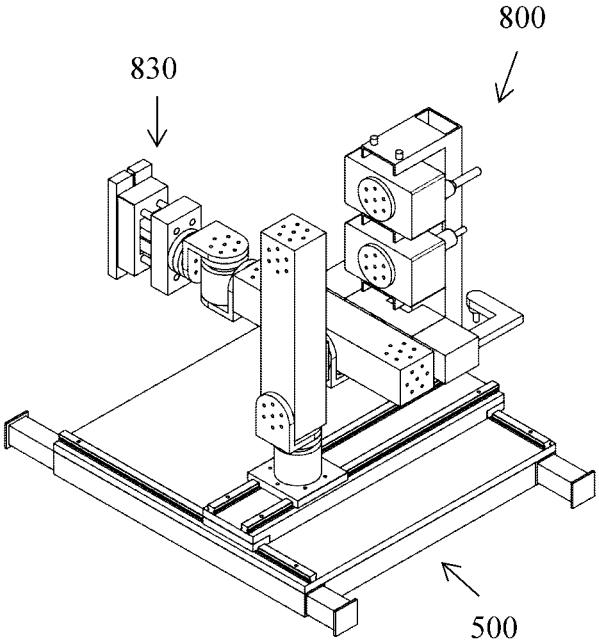
FIG. 10 shows the installation apparatus of FIG. 7 with a rail joining unit.

FIG. 10 shows the installation apparatus of FIG. 7 with a rail joining unit. The rail joining unit 830 is attached to the outer end of the support arm of the industry robot 850. The rail joining unit 830 comprises gripping means which can grip the guide rail 50 after which the guide rail 50 can be guided into position with the robot 850 on the installation apparatus 800. The upper end of the guide rail 50 is supported with the third hoist H3 i.e. most of the weight of the guide rail 50 is carried by the third hoist H3. The robot 850 does not have to carry the whole weight of the guide rail 50. The rail joining unit 830 comprises further a bolt driving apparatus with which the bolts in the joint between the two consecutive guide rails 50 can be tightened. The joint can be achieved with a fish plate that has been attached with bolts to the upper end of the lower guide rail element 50 in advance. The fish plate is then attached with bolts to the upper guide rail element.

Figure 11:
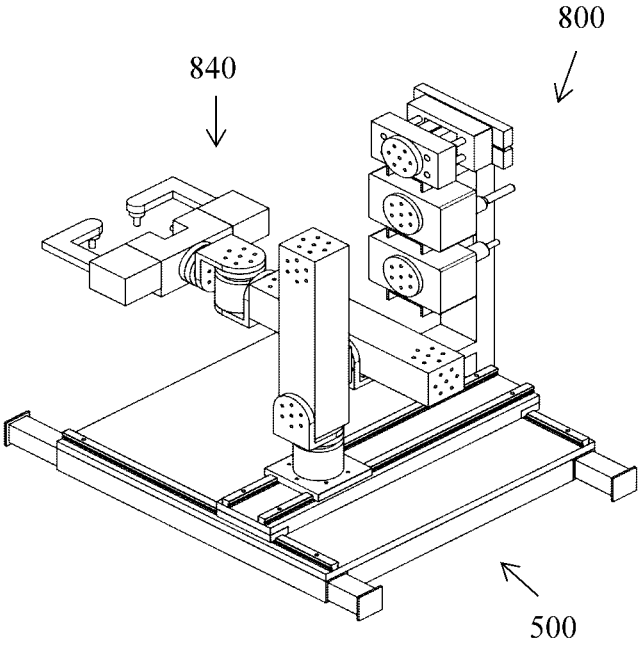
FIG. 11 shows the installation apparatus of FIG. 7 with a bracket bolting unit.

FIG. 11 shows the installation apparatus of FIG. 7 with a bracket bolting unit. The bracket bolting unit 840 is attached to the outer end of the support arm of the industry robot 850. The bracket bolting unit 840 is used to open and/or tighten the bracket bolts attaching the two parts in the support brackets 60. The opening of the bracket bolts between the two parts of the support bracket makes it possible to move the two parts of the support bracket in relation to each other. This makes it possible to align the guide rails 50. The tightening of the brackets bolts locks the two parts of the support bracket in relation to each other. The bracket bolting unit 840 comprises movable arms in order to be able to open and/or tighten the bracket bolts situated at the back farthermost from the bracket bolting unit 840.

The position of the installation platform 500 in relation to the shaft 20 can be determined in various ways.

A first possibility would be to install light sources e.g. laser transmitters on the bottom 12 of the elevator shaft 20 and to install position sensitive detectors on the lower surface of the installation platform 500. The position of the installation platform 500 can be determined based on the hitting points of the light beams on the position sensitive sensors.

A second possibility would be to install a robotic total station on the bottom 12 of the elevator shaft 20 and to install reflectors on the lower surface of the installation platform 500. The position of the installation platform 500 can be determined with the robotic total station, which measures the position of the reflectors on the installation platform 500 and thereby the position of the installation platform.

A third possibility would be to install light sources e.g. laser transmitters on the bottom 12 of the elevator shaft 20 and to install digital imaging devices on the installation platform 500. The digital imaging devices could be provided with a reflective or transparent screen at a distance in front of the photosensitive sensor of the digital imaging device. The reflective or transparent screen could easily be made greater than the photosensitive sensor of the digital imaging device making the possible hitting area for the light beam greater. The digital imaging device can take electronic images of either the light beam hitting the photosensitive sensor of the digital imaging device or of a pattern created by the light beam on the reflective or transparent screen. The position of the installation platform 500 can be determined from the electronic images taken by the digital imaging device.

When the position of the installation platform 500 in relation to the elevator shaft 20 is known it is possible to determine the position of the guide apparatus 700, the installation apparatus 800 and the alignment apparatus 400 positioned on the installation platform 500 in relation to the elevator shaft 20. The position of the guide apparatus 700, the installation apparatus 800 and the alignment apparatus 400 must first be determined in relation to the installation platform 500. In case the guide apparatus 700 and/or the installation apparatus 800 and/or the alignment apparatus 400 is movably attached to the installation platform 500 sensors are needed on the installation platform 500 in order to determine the position of the guide apparatus 700 and/or the installation apparatus 800 and/or the alignment apparatus 400 on the installation platform 500. In case the guide apparatus 700 and/or the installation apparatus 800 and/or the alignment apparatus 400 is stationary attached to the installation platform 500, then the position of the guide apparatus 700 and/or the installation apparatus 800 and/or the alignment apparatus 400 in relation to the installation platform 500 is stationary. The position of the gripping means etc. in the guide apparatus 700 and the installation apparatus 800 and the alignment apparatus 400 is naturally known in relation to the attachment point of the apparatus all the time by the apparatus itself.

Figure 12:
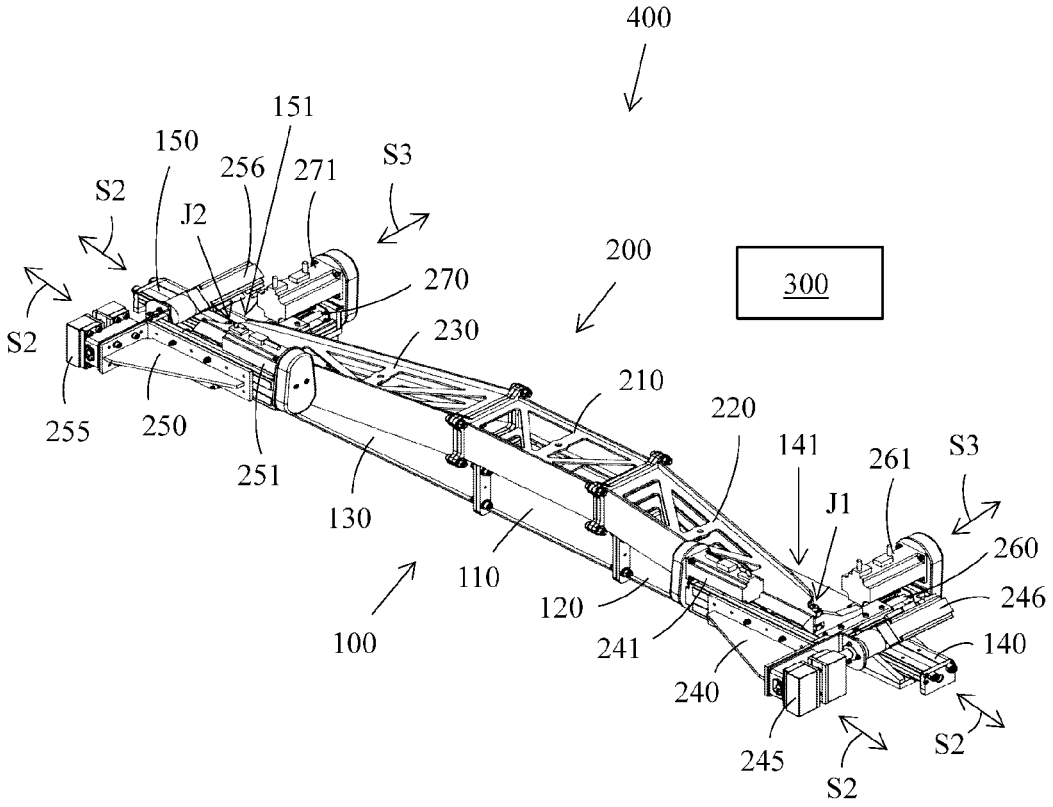
FIG. 12 shows an axonometric view of an apparatus for aligning guide rails in an elevator shaft.

FIG. 12 shows an axonometric view of an apparatus for aligning guide rails in an elevator shaft. The apparatus 400 for aligning guide rails 50 comprises a positioning unit 100 and an alignment unit 200.

The positioning unit 100 comprises a longitudinal support structure with a middle portion 110 and two opposite end portions 120, 130. The two opposite end portions 120, 130 are mirror images of each other. There could be several middle portions 110 of different lengths in order to adjust the length of the positioning unit 100 to different elevator shafts 20. The positioning unit 100 comprises further first attachment means 140, 150 at both ends of the positioning unit 100. The first attachment means 140, 150 are movable in the second direction S2 i.e. the direction between the guide rails (DBG). The positioning unit 100 extends across the elevator shaft 20 in the second direction S2. The first attachment means 140, 150 are used to lock the positioning unit 100 between the wall structures 21 and/or dividing beams and/or brackets 60 in the elevator shaft 20. An actuator 141, 151 (position shown only schematically in the figure) e.g. a linear motor in connection with each of the first attachment means 140, 150 can be used to move each of the first attachment means 140, 150 individually in the second direction S2.

The alignment unit 200 comprises a longitudinal support structure with a middle portion 210 and two opposite end portions 220, 230. The two opposite end portions 220, 230 are mirror images of each other. There could be several middle portions 210 of different lengths in order to adjust the length of the alignment unit 200 to different elevator shafts 20. The alignment unit comprises further second attachment means 240, 250 at both ends of the alignment unit 200. The second attachment means 240, 250 are movable in the second direction S2. An actuator 241, 251 e.g. a linear motor can be used to move each of the second attachment means 240, 250 individually in the second direction S2. Each of the second attachment means 240, 250 comprises further gripping means in the form of jaws 245, 255 positioned at to the end of the second attachment means 240, 250. The jaws 245, 255 are movable in the third direction S3 perpendicular to the second direction S2. The jaws 245, 255 will thus grip on the opposite side surfaces of the guide rails 50. An actuator 246, 256 e.g. a linear motor can be used to move each of the jaws 245, 255 individually in the third direction S3. The alignment unit 200 is attached to the positioning unit 100 at each end of the positioning unit 100 with support parts 260, 270. The support parts 260, 270 are movable in the third direction S3 in relation to the positioning unit 100. The alignment unit 200 is attached with articulated joints J1, J2 to the support parts 260, 270. An actuator 261, 271 e.g. a linear motor can be used to move each of the support parts 260, 270 individually in the third direction S3. The articulated joints J1, J2 make it possible to adjust the alignment unit 200 so that it is non-parallel to the positioning unit 100.

The two second attachment means 240, 250 are moved with the actuators 241, 251 only in the second direction S2. It would, however, be possible to add a further actuator to one of the second attachment means 240, 250 in order to be able to turn said second attachment means 240, 250 in the horizontal plane around an articulated joint. It seems that such a possibility is not needed, but such a possibility could be added to the apparatus 400 if needed.

The apparatus 400 can be operated by means of a control unit 300. The control unit 300 can be attached to the apparatus 400 or it can be a separate entity that is connectable with a cable to the apparatus 400. There can naturally also be a wireless communication between the control unit 300 and the apparatus 400. The control unit 300 is used to control all the actuators 141, 142 moving the first attachment means 140, 150, the actuators 241, 242 moving the second attachment means 240, 250, the actuators 246, 256 moving the gripping means 245, 255 and the actuators 261, 271 moving the support parts 260, 270.

Figure 13:
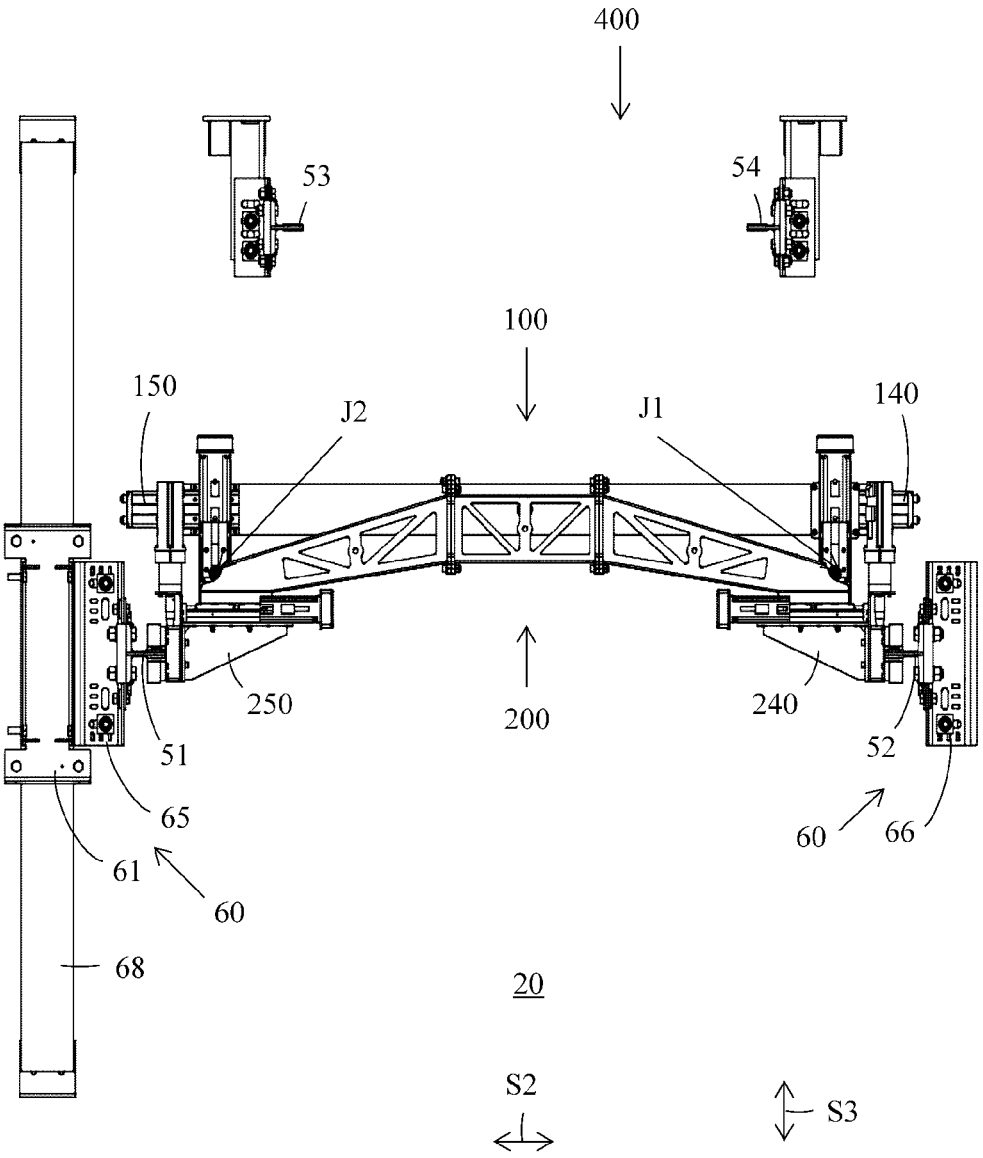
FIG. 13 shows a first phase of the operation of the apparatus of FIG. 3.

FIG. 13 shows a first phase of the operation of the apparatus of FIG. 12. The guide rails 51, 52 are attached to brackets 65, 66 and the brackets 65, 66 can be attached directly to the side wall 21C of the shaft 20 or through a support bar 68 extending between the back wall 21B and the front wall 21A of the shaft 20. The bracket 65 is attached to a bar bracket 61 and the bar bracket 61 is attached to the support bar 68. The apparatus 400 can be supported on an installation platform and lifted with the installation platform to a height location of the first fastening means 60 during the alignment of the guide rails 50. The apparatus 400 may be operated so that the alignment unit 200 is controlled to attach with the jaws 245, 255 at the ends of the second attachment means 240, 250 to the two opposite guide rails 51, 52. The second attachment means 240, 250 are movable in the second direction S2 and the jaws 245, 255 are movable in the third direction S3 so that they can grip on the opposite vertical side surfaces of the guide rails 51, 52. The bracket bolts locking the two brackets parts are then loosened at both sides of the shaft 20 so that the guide rails 51, 52 can be moved. The guide rails 51, 52 on opposite sides of the shaft 20 are then adjusted relative to each other with the alignment unit 200. The frame of the alignment unit 200 is stiff so that the two opposite guide rails 51, 52 will be positioned with the apexes facing towards each other when the gripping means 245, 255 grips the guide rails 50. There is thus no twist between the opposite guide rails 50 after this. The distance between the two opposite guide rails 51, 52 in the direction (DBG) is also adjusted with the alignment unit 200. The position of each of the second attachment means 240, 250 in the second direction S2 determines said distance.

A plumb line have been formed in the vicinity of each guide rail 51, 52 (shown in FIG. 2). The distance in the DBG and the BTF direction from the guide rails 51, 52 to the respective plumb line that is in the vicinity of said guide rail 51, 52 is then determined. The needed control values (DBG, BTF and twist) for the apparatus 400 are then calculated. The control values are then transformed into incremental steps, which are fed as control signals to the control units of the linear motors in the apparatus 400. The DBG can also be measured based on the motor torque, which indicates when the second attachment means 240, 250 have reached their end position and are positioned against the guide rails 50. The position of the linear motors can then be read from the display of the control unit 300. The apparatus 400 can thus calculate the DBG based on the distance of the guide rails 51, 52 to the plumb lines and based on the position of each of the second attachment means 240, 250 in the second direction S2.

Figure 14:
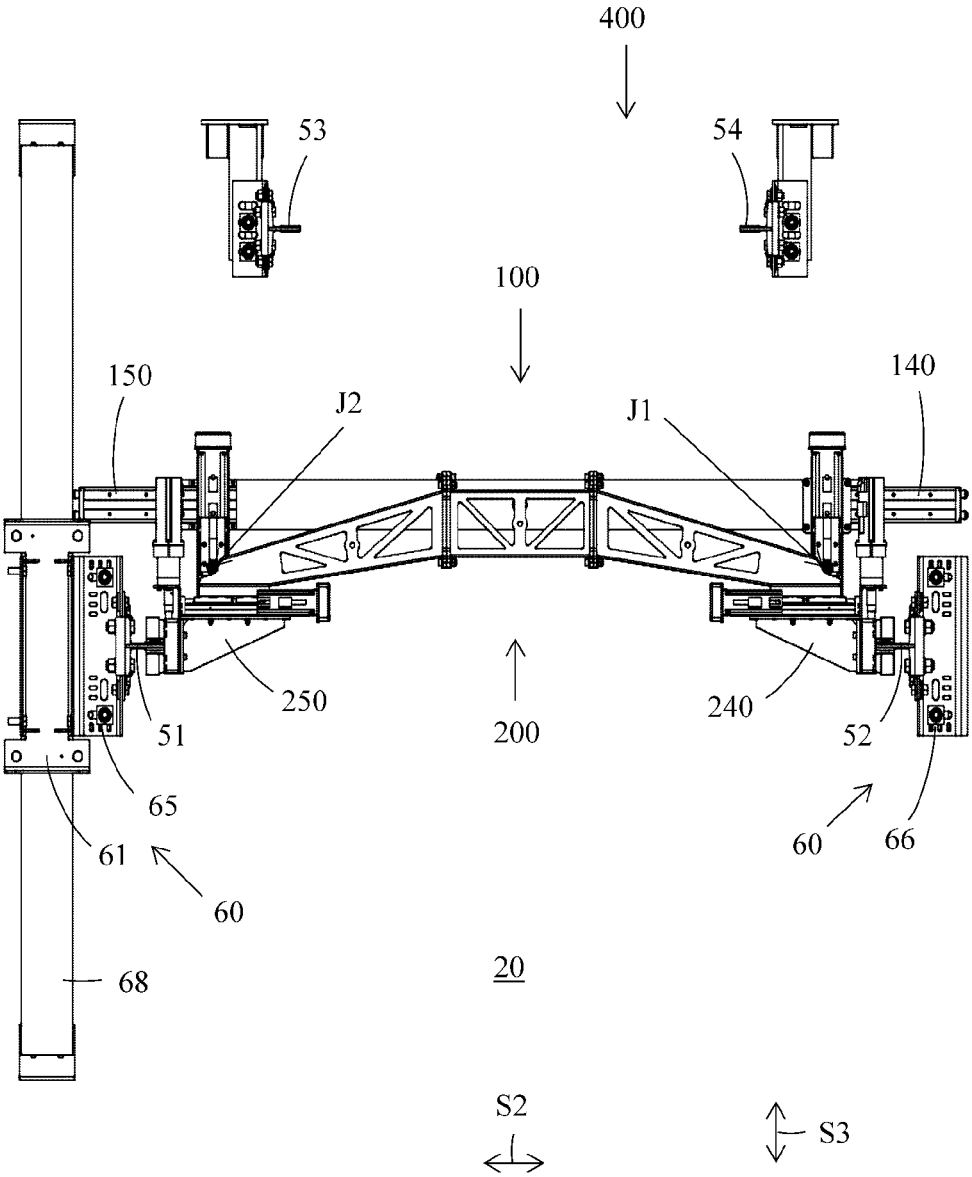
FIG. 14 shows a second phase of the operation of the apparatus of FIG. 3.

FIG. 14 shows a second phase of the operation of the apparatus of FIG. 12. The positioning unit 100 of the apparatus 400 is locked to the wall constructions 21 or other support structures in the elevator shaft 20 with the first attachment means 140, 150. The alignment unit 200 of the apparatus 400 is in a floating mode in relation to the positioning unit 100 when the positioning unit 100 is locked to the wall construction 21 of the elevator shaft 20. The guide rails 51, 52 can now be adjusted with the alignment unit 200 and the positioning unit 100 in relation to the shaft 20. The bracket bolts locking the two bracket parts are then tightened. The apparatus 400 can now be transported to the next location of the brackets 60 where the first phase and the second phase of the operation of the apparatus 400 is repeated.

Figure 15:
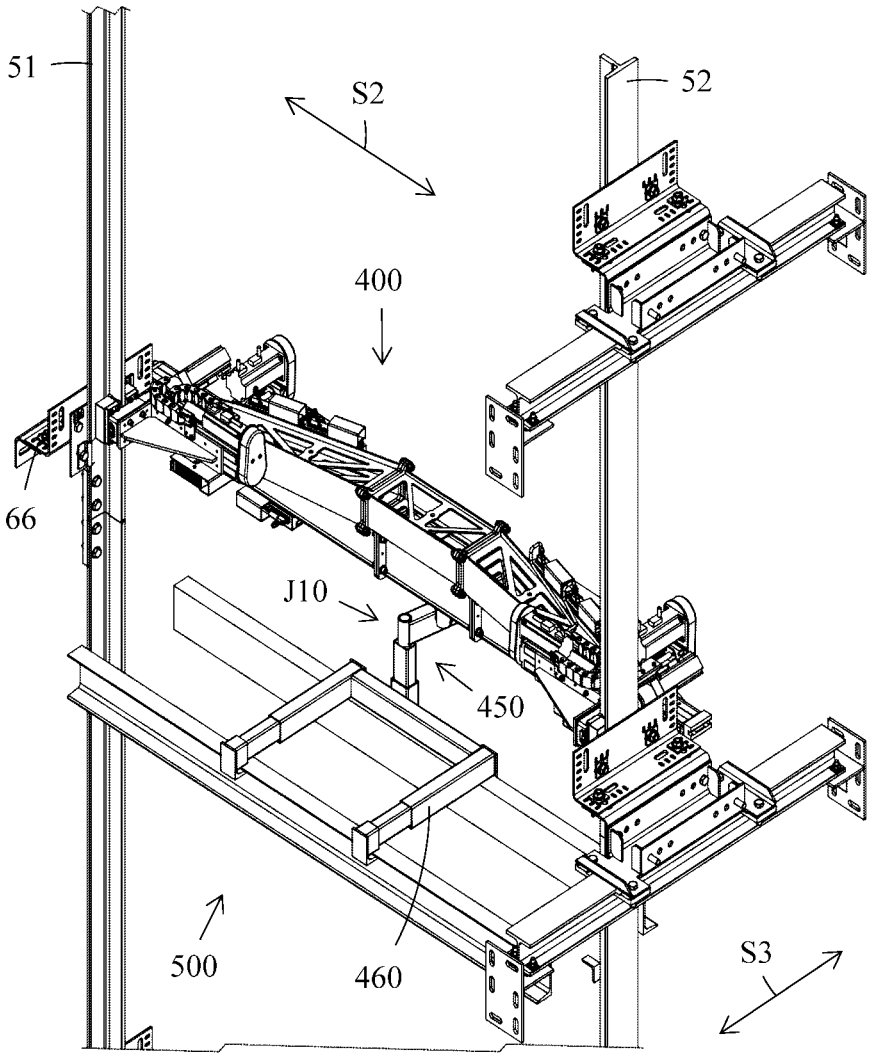
FIG. 15 shows an axonometric view of an elevator shaft with the alignment apparatus and the installation platform.

FIG. 15 shows an axonometric view of the alignment of guide rails in an elevator shaft. The figure shows the car guide rails 51, 52, the installation platform 500 and the apparatus 400 for aligning the guide rails 51, 52. The apparatus 400 for aligning the guide rails 51, 52 is attached with a support arm 450 to a support frame 460 and the support frame 460 is attached to the installation platform 500. The installation platform 500 is movable upwards and downwards along the car guide rails 51, 52 in the shaft 20. The apparatus 400 for aligning the guide rails 51, 52 is in this embodiment movable in the second direction S2 and in the third direction S3 in relation to the installation platform 500. This can be achieved with one or several joints 510 in the support arm 450. The support frame 460 can also be arranged to be movable in the second direction S2 and in the third direction S3. The position of the support arm 450 in relation to the installation platform 500 must be measured in order to determine the position of the alignment apparatus 400 in relation to the installation platform 500.

Figure 16:
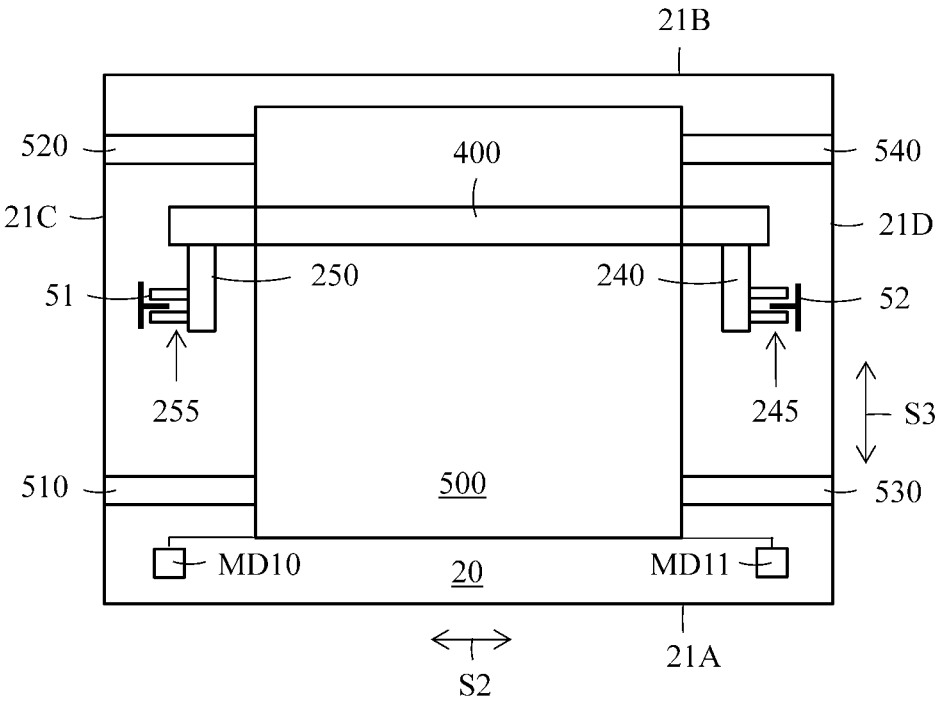
FIG. 16 shows a horizontal cross section of the elevator shaft provided with an installation platform.

FIG. 16 shows a horizontal cross section of the elevator shaft showing the alignment apparatus and the installation platform. The figure shows the installation platform 500, the apparatus 400 for aligning guide rails and two measuring devices MD10, MD11 supported on the installation platform 500. The installation platform 500 comprises support arms 510, 520, 530, 540 arranged on opposite sides of the installation platform 500 and being movable in a second direction S2 for supporting the installation platform 500 on the opposite side walls 21C, 21D of the shaft 20. The gripping means 245, 255 of the second attachment means 240, 250 can grip the opposite guide surfaces of the car guide rails 51, 52. The car guide rails 51, 52 can thus be aligned with the apparatus 400 for alignment of guide rails as described earlier in connection with FIGS. 12-14. The installation platform 500 is locked in place with the support arms 510, 520, 530, 540.

The position of the installation platform 500 in relation to the shaft 20 can be determined with the measuring devices MD10, MD11 based on the plumb lines PL1, PL2 once the installation platform 500 is locked in the shaft 20. The measuring devices MD10, MD11 can be based on sensor measuring without contact the position of the plumb lines PL1, PL2 being formed of wires. Another possibility is to use light sources e.g. lasers on the bottom of the elevator shaft producing upwards directed light beams that can be measured with the measuring devices MD10, MD11 on the installation platform 500. The measuring devices MD10, MD11 could be light sensitive sensors or digital imaging devices measuring the hit points of the light beams produced by the light sources. The light source could be a robotic total station, whereby the measuring devices MD10, MD11 would be reflectors reflecting the light beams back to the robotic total station. The robotic total station would then measure the position of the measuring devices MD10, MD11.

The alignment apparatus 400 can be attached stationary to the installation platform 500, whereby the position of the apparatus 400 can be determined indirectly based on the position of the installation platform 500. The position of the guide rails 51, 52 can be determined indirectly based on the position of the apparatus 400. The alignment apparatus 400 can on the other hand be attached movable to the installation platform 500, whereby sensors can be arranged on the installation platform 500 in order to measure the position of the alignment apparatus 400 on the installation platform 500.

The form of the guide rails 51, 52, 53, 54 is naturally not limited to the T form disclosed in the figures. The guide rails 51, 52, 53, 54 can be of any form, but the gripping means etc. must naturally be adapted to the form of the guide rails 51, 52, 53, 54.

The support brackets 60 used to attach the guide rails 51, 52, 53, 54 to the walls of the shaft 20 can be of any construction.

The method and the arrangement can be used to install car guide rails 51, 52 and/or to install counter weight guide rails 53, 54.

The method and the arrangement can be used in elevator installations where the hoisting height in the elevator shaft is over 30 m, preferably 30-80 meters, most preferably 40-80 meters.

The method and the arrangement can on the other hand also be used in elevator installations where the hoisting height in the elevator shaft is over 75 m, preferably over 100 meters, more preferably over 150 meters, most preferably over 250 meters. The efficiency of an automated installation process becomes more profound in a higher elevator shaft. Also the safety aspects become more profound in a higher elevator shaft. There is no need for a mechanic to travel on the installation platform in an automated installation process.

Some of the individual steps in the automatic installation process can be done manually if needed.

The use of the invention is not limited to the type of elevator disclosed in the figures. The invention can be used in any type of elevator e.g. also in elevators lacking a machine room and/or a counterweight. The counterweight is in the figures positioned on the back wall of the elevator shaft. The counterweight could be positioned on either side wall of the shaft or on both side walls of the elevator shaft. The lifting machinery is in the figures positioned in a machine room at the top of the elevator shaft. The lifting machinery could be positioned at the bottom of the elevator shaft or at some point within the elevator shaft.

It will be obvious to a person skilled in the art that, as the technology advances, the inventive concept can be implemented in various ways. The invention and its embodiments are not limited to the examples described above but may vary within the scope of the claims.

The invention claimed is:

1. An arrangement for installing guide rails into an elevator shaft, said arrangement comprising:

a first hoist;

a lifting frame glidingly supported on counter weight guide rails, arranged to move upwards and downwards in the elevator shaft with the first hoist, and configured to lift guide rail elements from a storage area;

a second hoist;

a third hoist, separate from the first and second hoists, and configured to lift the guide rail elements from the lifting frame, the third hoist including a gripping member; and an installation platform glidingly supported on car guide rails, and arranged to move upwards and downwards in the elevator shaft with the second hoist, the installation platform comprising:

a robotic installation apparatus configured to drill holes and fasten support brackets to walls of the elevator shaft;

a robotic guide apparatus configured to guide the gripping member of the third hoist to grip an upper end of the guide rail element lifted by the third hoist, and guide the guide rail element gripped by the gripping member into position; and an alignment tool, wherein:

consecutive guide rail elements are joined and the guide rail elements are attached to the support brackets with the installation apparatus, opposite guide rail elements are aligned with the alignment tool based on plumb lines at each support bracket along a height of the guide rail element, and the support brackets are locked and thereby also the guide rail elements with the installation apparatus.

2. The arrangement according to claim 1, wherein the arrangement comprises a main control unit for controlling the first hoist, the second hoist, the third hoist, the guide apparatus, the installation apparatus and the alignment tool.

3. The arrangement according to claim 1, wherein the installation apparatus is an industry robot with an arm.

4. The arrangement according to claim 1, wherein the installation apparatus comprises a drilling unit for installing the anchor bolts into the walls of the elevator shaft.

5. The arrangement according to claim 1, wherein the installation apparatus comprises a bracket installation unit for installing the support brackets into the walls of the elevator shaft.

6. The arrangement according to claim 1, wherein the installation apparatus comprises a rail joining unit for joining two consecutive rails in the elevator shaft.

7. The arrangement according to claim 1, wherein the installation apparatus comprises a bracket bolting unit for locking the support brackets and thereby the guide rail element in the elevator shaft.

8. The arrangement according to claim 1, wherein the guide apparatus is an industry robot with a pivot arm and gripper in order to be able to grip guide rails and to lift guide rails into their position on the walls of the elevator shaft.

9. The arrangement according to claim 8, wherein the arm of the guide apparatus is telescopic so that the guide apparatus can reach upwards along the height of the guide rail elements.

10. The arrangement according to claim 1, wherein a hoisting height of the elevator shaft is over 75 meters.

11. The arrangement according to claim 1, wherein the storage area is arranged below the working level of the installation platform.

12. The arrangement according to claim 1, wherein the storage area is arranged on a first landing of the elevator shaft.

13. The arrangement according to claim 1, wherein the alignment tool is supported on the installation platform, and comprises:

a positioning unit configured to lock the alignment tool to walls of the walls of the elevator shaft; and an alignment unit configured to adjust the opposite guide rail elements relative to each other.

14. The arrangement according to claim 1, further comprising positioning sensors arranged on the installation platform and configured to measure positions of one or more of the guide apparatus, the installation apparatus and the alignment tool.

15. A method for installing guide rails into an elevator shaft, said method comprising the steps of:

providing the arrangement according to claim 1;

plumbing the shaft and arranging plumb lines in the elevator shaft in the vicinity of car guide rail lines in accordance with the result of the plumbing;

installing manually a lowermost first section of guide rail elements to respective walls of the elevator shaft starting from a bottom floor level of the elevator shaft;

lifting guide rail elements from the storage area with the lifting frame being glidingly supported on counter weight guide rails and being movable upwards and downwards in the shaft with the first hoist;

arranging the installation platform being glidingly supported on car guide rails and being movable upwards and downwards in the shaft with the second hoist;

drilling holes and fastening support brackets to the walls of the elevator shaft with the installation apparatus;

lifting guide rail elements with the third hoist from the lifting frame and guiding said guide rail elements into position with the guide apparatus;

joining consecutive guide rail elements and attaching guide rail elements to the support brackets with the installation apparatus;

aligning opposite guide rail elements with the alignment tool based on the plumb lines at each support bracket along the height of the guide rail element; and locking the support brackets and thereby the guide rail elements with the installation apparatus.

16. The method according to claim 15, further comprising the step of controlling the first hoist, the second hoist, the third hoist, the guide apparatus, the installation apparatus and the alignment tool with a main control unit.

17. The method according to claim 15, further comprising the step of installing anchor bolts into the walls of the elevator shaft with a drilling unit provided on the installation apparatus.

18. The method according to claim 15, further comprising the step of installing the support brackets into the walls of the elevator shaft with a bracket installation unit provided on the installation apparatus.

19. The method according to claim 15, further comprising the step of joining two consecutive rails in the elevator shaft with a rail joining unit provided on the installation apparatus.

20. The method according to claim 15, further comprising the step of locking the support brackets and thereby the guide rail element in the elevator shaft with a bracket bolting unit provided on the installation apparatus.

21. The method according to claim 15, wherein the guide rails to be installed are car guide rails.

22. The method according to claim 15, wherein the guide rails to be installed are counter weight guide rails.

23. The method according to claim 15, wherein a hoisting height of the elevator shaft is over 75 meters.

24. The method according to claim 15, wherein the storage area is arranged below the working level of the installation platform.

25. The method according to claim 15, wherein the storage area is arranged on a first landing of the elevator shaft.

* * * * *